United States Patent [19]

Flatau

[11] Patent Number: 4,579,059

[45] Date of Patent: Apr. 1, 1986

[54] TUBULAR PROJECTILE HAVING AN EXPLOSIVE MATERIAL THEREIN

[76] Inventor: Abraham Flatau, 2003 Stockton Rd., Joppa, Md. 21085

[21] Appl. No.: 745,109

[22] Filed: Jun. 12, 1985

Related U.S. Application Data

[63] Continuation of Ser. No. 593,193, Mar. 27, 1984, abandoned, which is a continuation of Ser. No. 306,032, Sep. 28, 1981, abandoned.

[51] Int. Cl.[4] ..... F42B 11/22

[52] U.S. Cl. ..... 102/503; 102/476

[58] Field of Search ..... 102/501, 503, 508, 491, 102/492–497, 475, 476, 305–310

[56] References Cited

U.S. PATENT DOCUMENTS

| | | | |
|---|---|---|---|
| 1,303,727 | 5/1919 | Rice | 102/493 X |
| 1,320,495 | 11/1919 | Rohling | 102/503 X |
| 1,367,464 | 2/1921 | Cook | 102/493 |
| 3,416,449 | 12/1968 | Brothers | 102/476 |
| 3,877,383 | 4/1975 | Flatau | 102/503 |
| 4,291,627 | 9/1981 | Ziemba | 102/211 X |
| 4,301,736 | 11/1981 | Flatau et al. | 102/501 X |
| 4,436,035 | 3/1984 | Strandli | 102/503 |

FOREIGN PATENT DOCUMENTS

| | | | |
|---|---|---|---|
| 2454584 | 5/1975 | Fed. Rep. of Germany | 102/503 |
| 1192170 | 10/1959 | France | 102/514 |

*Primary Examiner*—Harold J. Tudor

*Attorney, Agent, or Firm*—Anthony T. Lane; Robert P. Gibson; Edward F. Costigan

[57] ABSTRACT

An elongated tubular projectile is provided comprising a tubular side wall structure having inner and outer surfaces and an annular chamber formed between the inner and outer surfaces for receiving explosive material. The annular chamber can be provided with an internal peripheral surface adjacent to the outer surface of the tubular side wall and a grid of intersecting grooves formed in the internal peripheral surface to facilitate the production of a uniform distribution of fragments. Additionally, the projectile can be provided with a central portion and a nose portion having inner and outer walls adjoining the central portion. The inner wall of the nose portion can comprise a liner which, upon ignition of the explosive material, collapses upon itself and is propelled forward to define a self-forging armor piercing fragment.

1 Claim, 4 Drawing Figures

TUBULAR PROJECTILE HAVING AN EXPLOSIVE MATERIAL THEREIN

STATEMENT OF GOVERNMENT INTEREST

The invention described herein may be manufactured, used and licensed by or for the Government for Governmental purposes without the payment of any royalties thereon.

This application is a continuation of application Ser. No. 593,193, filed Mar. 27, 1984, now abandoned which is a continuation of application Ser. No. 306,032, filed Sept. 28, 1981, now abandoned.

FIELD OF THE INVENTION

The present invention relates to tubular projectiles and more particularly to such tubular projectiles incorporating an explosive material within an annular chamber formed therewithin.

BACKGROUND OF THE INVENTION

There exists a continuing need to reduce the aerodynamic drag of projectiles fired from various size guns to increase the range and the impact characteristics or terminal ballistics of such projectiles. In order to accomplish such design objectives various tubular projectile designs have been evaluated and studied. A projectile which advantageously utilizes the tubular design is described in U.S. patent application Ser. No. 20,140, which was filed on Mar. 13, 1979, now U.S. Pat. No. 4,301,736, the contents of which are incorporated by reference in this application.

Although most of such previously considered tubular projectile designs have relied on their mass and terminal velocity to achieve destructive impact, U.S. patent application Ser. No. 050,288, now abandoned which was filed on June 20, 1979 discloses a tubular projectile which can be provided with an external layer of incendiary material. Tubular projectiles have not, however, been provided with explosive material to function in the manner of conventional high explosive artillery shells and conventional explosive air defense projectiles. In this regard, it has been thought that the tubular geometry precludes a sufficient explosive charge to fragmentation mass ratio to achieve high fragment velocities.

SUMMARY OF THE INVENTION

In accordance with the present invention an elongated tubular projectile is provided comprising a tubular side wall structure and receiving means for receiving explosive material within the tubular side wall structure.

As a preferred embodiment, the tubular side wall structure can comprise an inner and an outer surface. In accordance therewith, the explosive receiving means can be located between the inner and outer surfaces of the tubular side wall structure so that the explosive material is completely encased therein.

As another preferred embodiment the explosive receiving means can comprise an annular chamber formed between the inner and outer surfaces of the tubular side wall structure.

As another preferred embodiment, the annular chamber can have an internal peripheral surface adjacent to the outer surface of the tubular side wall structure and a grid of intersecting grooves formed in the internal peripheral surface to facilitate the production of a uniform distribution of high velocity fragments.

As another preferred embodiment, the projectile can include a central portion, a nose portion adjoining the central portion at one end and an aft portion adjoining the central portion at the other end. In one embodiment, an annular chamber can be formed in the central portion. In another embodiment, the nose portion can be defined by a pair of converging inner and outer frustro-conical walls intersecting one another to also form an annular chamber in the nose portion. In such an embodiment, explosive material can be located in the nose portion and the central portion. Additionally, in such embodiment, at least a portion of the inner frustro-conical wall of the nose portion can comprise a liner which, upon ignition of the explosive material, collapses upon itself and is propelled forward to define a self-forging, armor piercing fragment.

BRIEF DESCRIPTION OF THE DRAWINGS

The specification concludes with claims particularly pointing out and distinctly claiming the subject matter of the present invention. It is believed, however, that the invention will be better understood from the following description taken in connection with the accompanying drawings in which:

DETAILED DESCRIPTION

While the present invention is by no means limited to the embodiment illustrated therein, the invention will for simplicity be described in connection therewith.

Figure 1:
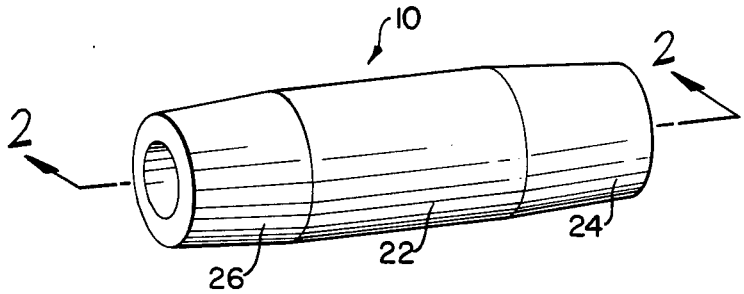
FIG. 1 is a perspective view of a preferred embodiment of the tubular projectile of the present invention.

Referring now to FIG. 1, there is illustrated a preferred tubular projectile 10 of the present invention. The tubular projectile 10 generally comprises a tubular side wall 20 (see FIGS. 1 and 2) which can comprise a central portion 22, a nose portion 24 and an aft portion 26.

Figure 2:
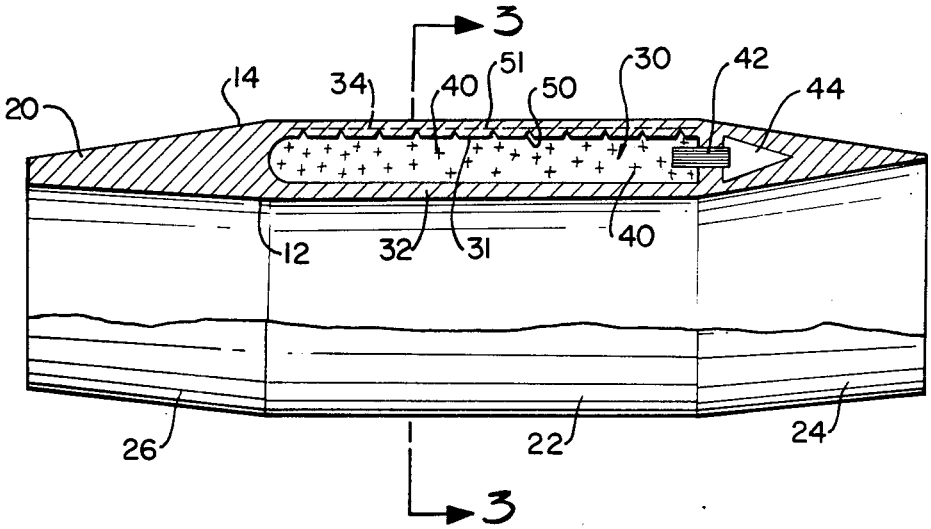
FIG. 2 is a partial cross-sectional view of the projectile shown in FIG. 1 taken along section line 2—2 illustrating a preferred embodiment for the explosive receiving means, the fragmented producing means and the igniting means.
Figure 3:
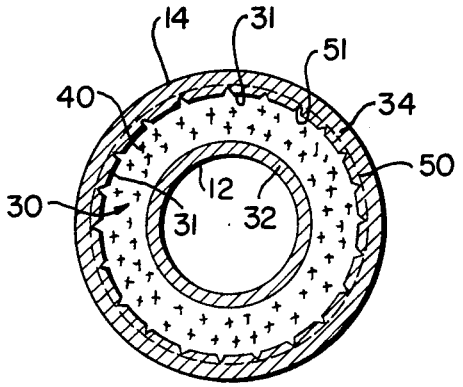
FIG. 3 is an axial cross-sectional view of the preferred embodiment shown in FIG. 2 taken along section line 3—3 of FIG. 2.
Figure 4:
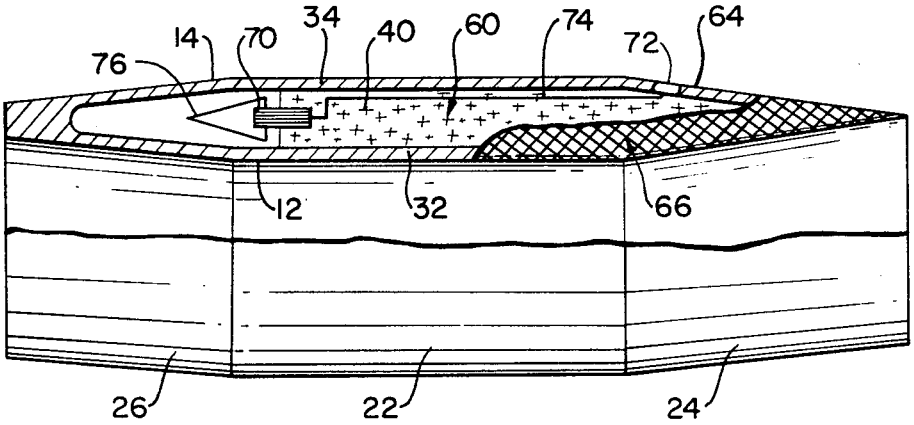
FIG. 4 is a partial cross-sectional view of the tubular projectile shown in FIG. 1 taken along section line 2—2 illustrating another preferred embodiment for the explosive receiving means, the fragment producing and self-forging fragment means and the explosive initiating means.

The tubular projectile 10 is provided with explosive receiving means for receiving explosive material which can comprise an annular chamber which is preferably principally formed within the central portion 22 of the tubular side wall 20, i.e., between the tubular inner and outer surfaces 12 and 14 thereof. Referring now to FIGS. 2 and 4, there are respectively illustrated alternative embodiments 30 and 60 for such annular chambers. The embodiment illustrated in FIG. 2 can be provided with fragment facilitating means which can comprise a grid of intersecting grooves 50 and 51, (see FIG. 3) and an igniting means 42. The embodiment illustrated in FIG. 4 can be provided with fragment facilitating means which can comprise a liner 66 and igniting means which can comprise a detonator 70, a fuse 76, sensor means 72 (e.g., an optical-electro sensor of the type well-known in the art), and communication means 74 between sensor means 72 and the detonator 70.

Referring again to FIG. 2 for a more detailed description of the preferred embodiment illustrated therein, it can be seen that the annular chamber 30 is defined by a pair of coaxially spaced apart inner and outer walls 32 and 34 located in central portion 22. As seen most clearly in FIG. 3, the explosive material 40 is disposed between the inner and outer walls 32 and 34 so as to have an annular cross-section. Igniting means (e.g., detonator) 42, which is in communication with the explosive material 40, is provided in the nose section 24, together with fuse 44. Depending upon the mission requirements for the projectile 10, a target proximity fuse or an impact fuse can be employed. Additionally, fragment facilitating means can be provided which can comprise a grid of intersecting grooves 50 and 51 in the internal peripheral surface 31 of the annular chamber 30. The provision of grooves 50 and 51. In a manner which is well known in the art, produces a uniform distribution of high velocity fragments, effective against personnel and material upon ignition of explosive material 40.

Although the explosive charge to fragmentation mass ratio is significantly lower than that of a conventional projectile of the same diameter, fragment velocity and fragment distribution compare favorably with that of such a conventional high explosive projectile. While not wishing to be bound by any particular theory of operation, it is believed that this is due to implosion waves meeting along the center line of the projectile and reflecting outwardly to provide additional force behind the initial explosive wave.

Referring again to FIG. 4 for a more detailed description of the embodiment illustrated therein, it can be seen that explosive receiving means 60 is again defined by a pair of coaxially spaced apart inner and outer walls 32 and 34 to form an annular chamber in central portion 22 of the tubular side walls, and a pair of converging inner and outer frustroconical walls 62 and 64, so as to also form an annular chamber in the nose portion 24. Explosive material 40 is disposed between inner and outer walls 32 and 34; and between inner and outer frustroconical walls 62 and 64. As illustrated, the inner frustroconical wall 62, and a portion of the inner wall 33 can comprise a liner 66, which will be discussed in more detail hereinafter. Igniting means are again provided, which can comprise a detonator 70, a fuse 76, sensor means 72, and communication means 74. The detonator 70 and fuse 76 are located in the aft portion 26, in communication with the explosive material 40. The sensor means 72, which is located in the nose portion 24, generates an impulse to initiate the fuse 76 and the detonator 70 when sensor means 72 contacts a target. As illustrated, the sensor means 72 can comprise an optical-electro means in nose portion 24 for the generation of an electrical impulse. Communication means 74 are provided for transmitting that impulse to the fuse 76. Communication means 74 can comprise electrical circuitry for transmitting the impulse from the sensor means 72 to the fuse 76 prior to or upon impact. As a result of such an arrangement, the explosive material is ignited upon contact of the sensor means 72 with the target prior to the time the nose portion 24 contacts the target. Upon initiation of the fuse 76 and the detonator 70, the explosive ignites to produce an explosive wave propagating towards the nose section 24. The wave causes the liner 66 to collapse upon itself. At this point, heat produced from the explosion of the explosive material 40 and the rapid deformation of the liner 66 raises the temperature of the liner 66 almost to the melting point. The liner is then propelled forward in the direction of the flight of the projectile prior to the time the nose section contacts the target. The collapsed, heated liner defines a self-forging fragment which is effective against armor plate. A preferred material for forming the liner 66 is copper.

Although the liner 66 as illustrated in the hereinbefore described embodiment includes a portion of the inner wall 32, it is understood that all that is required for the liner 66 is that it have a frustro-conical configuration to collapse upon ignition of the explosive material 40. Thus, the liner could comprise only a portion of the inner frustro-conical wall 62.

All such changes and omissions are intended to be included within the scope of the invention as defined in the appended claims.

I claim:

1. In an improved elongated tubular projectile having a longitudinal center axis consisting of:

a cylindrical center throat tubular portion having a wall defined by concentric inner and outer spaced-apart surfaces, a forward tubular compression section adjoining said throat portion and having walls formed by two converging conical surfaces which intersect each other to form a sharp leading edge and enclosing a V-shaped leading edge angle, the bisector of which in the longitudinal cross-section is substantially parallel to said longitudinal center axis, an aft diffusion section adjoining said throat portion and formed by two converging conical surfaces forming a V-shaped trailing edge, said aft section having a smooth constant expansion angle and a smooth transition from said adjoining throat portion to said trailing edge, said throat portion having constant diameter throughout the length of said inner surface, said sharp leading edge defining a circular inlet having a predetermined first cross-sectional area for inlet airflow, said throat portion diameter defining a constant second cross-sectional area for airflow through said throat portion, the ratio of said second area to said first area being not less than 0.6, the improvement consisting of:

an annular chamber in said center throat portion between said concentrix inner and outer spaced-apart surfaces defining said tubular wall, said annular chamber having inner and outer walls in said center portion extending into inner and outer frustroconical walls in said forward section, said inner frustroconical wall and a portion of said inner wall of said center portion consisting of a liner, said chamber provided with explosives having detonating means in said aft section communicating with sensor means in said forward section, said explosive completely filling said chamber and surrounding said liner, said sensor means generating an impulse to said detonating means upon detection of a target producing an explosive wave upon detonation of said explosive, said wave propagating to said forward section causing said liner to collapse into a propelled self-forging armor piercing fragment.

* * * * *